US006471493B2

(12) United States Patent
Choi et al.

(10) Patent No.: US 6,471,493 B2
(45) Date of Patent: Oct. 29, 2002

(54) ASSEMBLY STRUCTURE FOR A TURBO COMPRESSOR

(75) Inventors: Moon Chang Choi; Sang Wook Lee, both of Kwangmyung; Yoo Choi Ji, Incheon; Kwang Ha Suh, Kunpo, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/766,578

(22) Filed: Jan. 23, 2001

(65) Prior Publication Data

US 2002/0037225 A1 Mar. 28, 2002

(30) Foreign Application Priority Data

Sep. 27, 2000 (KR) ..... 2000-56737

(51) Int. Cl.[7] ..... F04B 17/00; F04B 35/00; F04B 35/04; F16C 1/24

(52) U.S. Cl. ..... 417/350; 417/357; 417/360; 417/423.12; 417/423.14; 384/202

(58) Field of Search ..... 384/192, 194, 384/196, 199, 202; 417/244, 247, 350, 357, 360, 423.15, 423.12, 423.14

(56) References Cited

U.S. PATENT DOCUMENTS 1,086,781 A * 2/1914 Miller ..... 384/199
1,352,204 A * 9/1920 Leitch ..... 384/200
1,639,684 A * 8/1927 Bott ..... 277/419
2,603,157 A * 7/1952 Conery ..... 415/101
2,674,404 A * 4/1954 Wieseman ..... 310/54
2,793,506 A * 5/1957 Moody ..... 310/54
2,886,380 A * 5/1959 Lambeek ..... 267/161
3,063,761 A * 11/1962 Hoddy et al. ..... 384/202
3,088,042 A * 4/1963 Robinson ..... 310/54
3,701,574 A * 10/1972 Phillips ..... 384/204
3,833,274 A * 9/1974 Lorenz et al. ..... 384/196
4,125,345 A * 11/1978 Yoshinaga et al. ..... 415/179
5,857,348 A * 1/1999 Conry ..... 417/423.12

* cited by examiner

*Primary Examiner*—Cheryl J. Tyler
*Assistant Examiner*—Timothy P. Solak
(74) *Attorney, Agent, or Firm*—Birch, Stewart, Kolasch & Birch, LLP

(57) ABSTRACT

The present invention relates to a turbo compressor which is capable of minimizing deformation of construction parts which may occur in welding or after welding and simplifying the manufacture and assembly by forming the outer diameter of a driving shaft so as to be stepped and joining the construction parts with bolts and pins. The turbo compressor in accordance with the present invention comprises a sealed container having separate inlets on each end, a first bearing housing and a second bearing housing and a driving motor installed inside of the sealed container, a driving shaft with its both ends separately inserted-penetrates through holes in the first and second bearing housings, a sealing member fixedly joined to the first bearing housing, a radial supporting member for supporting the driving shaft in the radial direction, first and second impellers and first and second diffuser members fixedly connected to the both ends of the driving shaft, an interconnection pipe for connecting the inlets, and an axial supporting member for supporting the driving shaft in the axial direction.

15 Claims, 3 Drawing Sheets

ASSEMBLY STRUCTURE FOR A TURBO COMPRESSOR

BACKGROUND OF THE INVENTION

1. Field of the Invention

The present invention relates to a turbo compressor, in particular to a turbo compressor which is capable of minimizing deformation of construction parts occurred in welding or after welding, and simplifying a manufacture and an assembly.

2. Description of the Prior Art

In general, a refrigerating cycle apparatus comprises a compressor for compressing working fluid such as refrigerant in order to convert it into a high temperature and high pressure state, a condenser for releasing internal latent heat to the outside while converting the working fluid compressed in the compressor in the high temperature and high pressure state into liquid phase state, an expanding unit for lowering the pressure of the working fluid converted into the liquid phase in the condenser, and an evaporator for absorbing heat from the outside of the evaporator while vaporizing the working fluid in the liquid phase state expanded in the expanding unit, and each construction part is connected by an interconnection pipe.

As described above, the refrigerating cycle apparatus is installed in a refrigerator or an air conditioner in order to preserve foodstuffs in a fresh state by using cold air generated from the evaporator or maintain a room as a pleasant state by using cold air or hot air generated from the evaporator or the condenser.

Meanwhile, the compressor comprises a power generation unit for generating driving force, and a compressing unit for compressing gas in accordance with the driving force transmitted from the power generation unit. The compressor type is divided into a rotary compressor, a reciprocating compressor, a scroll compressor, etc. in accordance with a gas compressing method of the compressing unit.

In more detail, in the rotary compressor, a rotating shaft is rotated by the rotating driving force transmitted from a motor unit, and an eccentric portion of the rotating shaft is rotated by being line-contacted with an inner surface of a cylinder, and accordingly the gas is compressed while changing the volume of the internal space of the cylinder.

And, the reciprocating compressor compresses gas with the rotating driving force transmitted from the motor unit translated as a linear reciprocation motion to a piston through a crank shaft and a connecting rod and by performing the linear reciprocation motion of the piston inside the cylinder.

In addition, the scroll compressor compresses gas with the rotating driving force transmitted from the motor unit, performing a rotating operation of a rotary scroll engaged with a fixed scroll, and changing a volume of a compression pocket formed by the wrap of the fixed scroll and the wrap of the rotary scroll.

However, because the rotary compressor, the reciprocating compressor, or the scroll compressor take in gas, compress it, and discharge it by periodic volume change, the compressed gas can not be discharged continuously. In addition, vibration and noise problems of the apparatuses occur due to the periodic discharge of the compressed gas.

On the contrary, a turbo compressor having an advantage in the vibration and noise is used for a bulk air conditioning such as a building, a factory, a plant, a ship etc. until now, and accordingly only a custom small quantity can be produced because of its volume and scale.

However, there is limit to perform mass production of a small turbo compressor with a structure and a manufacturing method of the conventional bulk turbo compressor.

SUMMARY OF THE INVENTION

The object of the present invention is to provide a turbo compressor which is capable of ease in manufacturing and assembling of parts.

In order to achieve the object, the turbo compressor in accordance with the present invention comprises a sealed container having an internal space and an inlet respectively on both ends, a first bearing housing and a second bearing housing installed at left and right portions inside of the internal space of the sealed container with a certain interval therebetween and each having a through hole in a center portion thereof, a driving motor installed between the first bearing housing and second bearing housing, a driving shaft combined to the driving motor and with its both ends respectively inserted-penetrated into the through holes in the first bearing housing and second bearing housing, a sealing member through which is inserted the driving shaft and fixedly connected with the first bearing housing, radial supporting means respectively inserted between the driving shaft and first bearing housing and between the driving shaft and second bearing housing, a first impeller connected with the one end of the driving shaft, a second impeller fixedly connected to the other end of the driving shaft, a first diffuser member fixedly connected to the sealing member by being placed on the outer circumference of the first impeller, a second diffuser member fixedly connected to the second bearing housing by being placed on the outer circumference of the second impeller, an interconnection pipe for connecting the inlets, and an axial supporting means installed between the side of the driving shaft and side of the sealing member.

DETAILED DESCRIPTION OF THE PREFERRED EMBODIMENT

The turbo compressor in accordance with the present invention will now be described with reference to the accompanying drawings.

Figure 1:
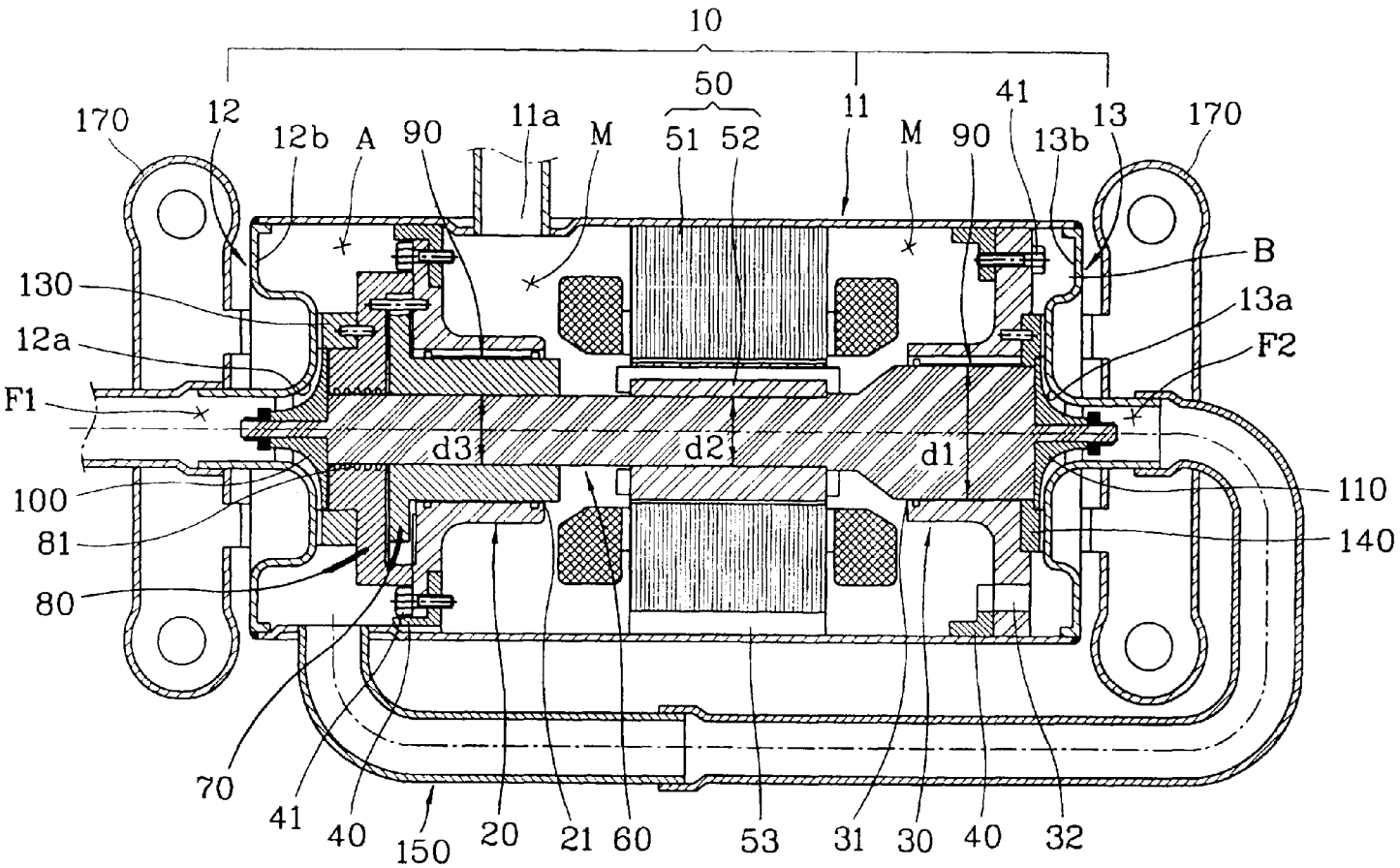
FIG. 1 is a cross-sectional view illustrating a turbo compressor in accordance with the present invention.

As depicted in FIG. 1, in the turbo compressor in accordance with the present invention, a first bearing housing 20 and a second bearing housing 30 are respectively installed on the left and the right sides with a certain interval therebetween inside of an inner space of a sealed container 10.

The internal space of the sealed container 10 is divided into a motor chamber M and first and second compressing chambers A, B by the first and second bearing housings 20, 30.

In more detail, the space between the first and second bearing housings 20, 30 is formed as the motor chamber M, the space between the first bearing housing 20 and the side of the sealed container 10 is formed as the first compressing chamber A, and the space between the second bearing housing 30 and the other side of the sealed container 10 is formed as the second compressing chamber B.

The sealed container 10 comprises a cylinder body unit 11 having a certain inner diameter and a certain length, and first and second cover plates 12, 13 formed so as to have dimensions corresponding to the radial cross section of the cylinder body unit 11 in order to cover-join with the both ends of the cylinder body unit 11.

Figure 2:
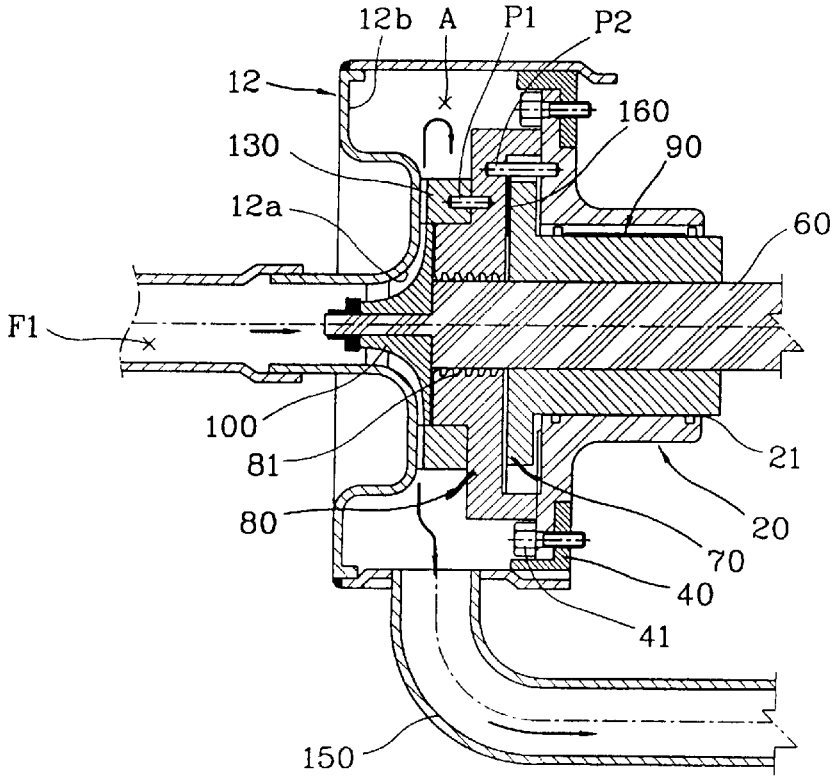
FIG. 2 is a cross-sectional magnified view of a first impeller and a first compressor part constructing the turbo compressor in accordance with the present invention.
Figure 3:
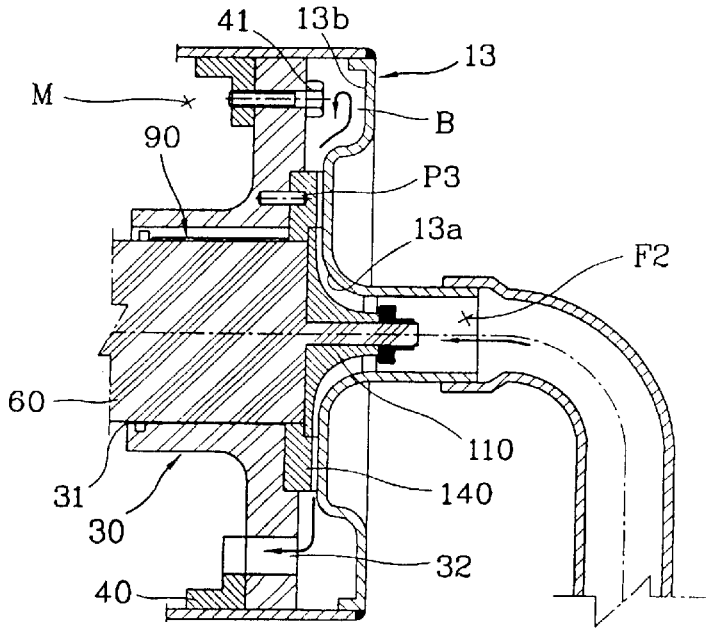
FIG. 3 is a cross-sectional magnified view of a second impeller and a second compressor part constructing the turbo compressor in accordance with the present invention.

As depicted in FIGS. 2 and 3, the first and second cover plates 12, 13 have a disk shape, with inlets F1, F2 respectively formed in the center portion thereof. Shroud portions 12*a*, 13*a* are curvedly-formed by extending the outer circumferences of the inlets F1, F2 as a curvedly surface similar with a cone shape, and volute portions 12*b*, 13*b* are respectively formed between the outer circumference ends of the shroud portions 12*a*, 13*a* and the both ends of the cylinder body unit 11.

The first and second cover plates 12, 13 are joined with the cylinder body unit 11 after press-processing of the first and second cover plates 12, 13 and processing of the shroud portions 12*a*, 13*a*.

The installation process for installing the first and second bearing housings 20, 30, having the through holes 21, 31 formed in the center portion thereof, inside of the sealed container 10 will now be described.

When the outer circumferences of the first and second bearing housings 20, 30 are respectively contacted to the fixing member 40 by inserting-fixing the fixing member 40 between the inner circumference of the sealed container 10 and outer circumference of the first and second bearing housings 20, 30, the first and second bearing housings 20, 30 and fixing member 40 are fixedly connected by a fastening means 41.

Generally, a bolt is used as the fastening means 41.

Accordingly, the present invention can improve productivity by minimizing deformation in the welding or after welding and reducing welding time by fastening the first and second bearing housings 20, 30 with bolts without welding it when the first and second bearing housings 20, 30 are assembled.

A driving motor 50 comprising a stator 51 fixed to the inner circumference of the sealed container 10 and a rotor 52 inserted inside of the stator 51 so as to be rotatable therein is installed inside of the motor chamber M.

In addition, a driving shaft 60 having a certain length is inserted inside of the rotor 52 of the driving motor 50, and the both ends of the driving shaft 60 are respectively inserted into the through hole 21 in the first bearing housing 20 and through hole 31 in the second bearing housing 30.

A bearing bush 70 having a certain shape is inserted between the first bearing housing 20 and driving shaft 60. The bearing bush 70 is inserted-fixed by contacting to the outer circumference of the driving shaft 60, and at the same time has a certain interval from the inner circumference of the through hole 21 in the first bearing housing 20.

A sealing member 80 having a certain shape is fixedly joined to the first bearing housing 20 in order that the driving shaft 60 can be inserted inside of it and cover the bearing bush 70.

The shape of the sealing member 80 will now be described in more detail. A labyrinth sealing part 81 having a plurality of consecutive ring shape grooves is formed on the inner circumference of the sealing member 80 where the driving shaft 60 is inserted.

In addition, the radial supporting means 90 for supporting the driving shaft 60 in the radial direction are respectively inserted between the driving shaft 60 and first bearing housing 20 and between the driving shaft 60 and second bearing housing 30.

Figure 4:
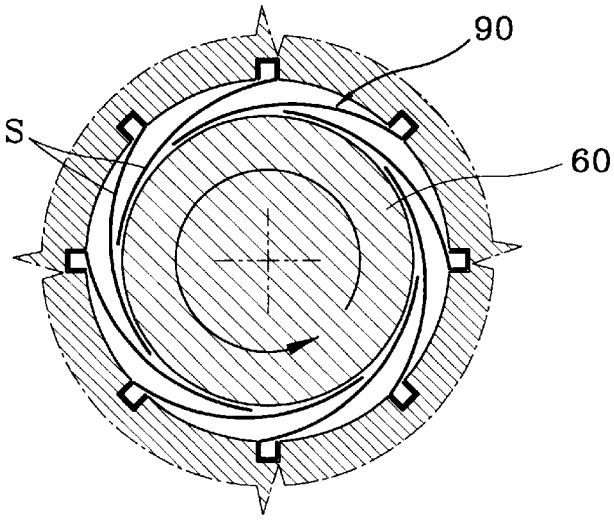
FIG. 4 is a front view illustrating a radial supporting means constructing the turbo compressor in accordance with the present invention.

As depicted in FIG. 4, the radial supporting means 90 comprises a plurality of foils S having a thin plate shape with a certain dimension.

A first impeller 100 is fixedly connected to the end portion of the driving shaft 60, and a second impeller 110 is fixedly connected to the other end portion of the driving shaft 60. Herein, the first impeller 100 is connected so as to be placed in the first compressing chamber A, and the second impeller 110 is connected so as to be placed in the second compressing chamber B.

The first and second impellers 100, 110 are formed so as to be similar to a cone shape, and when the first and second impellers 100, 110 are connected to the end portions of the driving shaft 60, they are placed on the portions corresponding to the shroud portions 12*a*, 13*a* of the first and second cover plates 12, 13.

In other words, the first impeller 100 and second impeller 110 are connected to the driving shaft 60 in a back to back manner.

And, as depicted in FIG. 2, the first diffuser member 130 is placed on the outer circumference of the impeller 100 and is fixedly combined to the sealing member 80. The first diffuser member 130 performs a function for converting to dynamic pressure generated by the first impeller 100 into static pressure together with the shroud portion 12*a* of the curved portion of the first cover plate 12 and the volute portion 12*b*.

In addition, the second diffuser member 140 placed on the outer circumference of the second impeller 110 is fixedly combined to the second bearing housing 30. The second diffuser member 140 performs a function for converting dynamic pressure generated by the second impeller 110 into static pressure together with the shroud portion 13*a* of the curved portion of the second cover plate 13 and the volute portion 13*b*.

The sealing member 80 is connected to the first bearing housing 20 by a pin P2, the first diffuser member 130 is combined to the sealing member 80 by a pin P1, and the sealing member 80 and first diffuser member 130 are fixed by adhering and fixing the first cover plate 12 of the sealed container 10 to the cylinder body unit 11.

In addition, the second diffuser member 140 is connected to the second bearing housing 30 by a pin P3, and the second diffuser member 140 is fixed by adhering and fixing the second cover plate 13 of the sealed container 10 to the cylinder body unit 11.

And, the inlet F2 located in the second compressing chamber B is connected with the side of the first compressing chamber A by an interconnection pipe 150 for guiding gas which has been first-stage compressed in the first compressing chamber A by the rotation of the first impeller 100 to the second compressing chamber B.

And, the present invention comprises a gas discharge flow channel for guiding the gas which has been second-stage compressed in the second compressing chamber B by the rotation of the second impeller 110 so as to discharge it to the exterior of the sealed container 10 through the motor chamber M while cooling the driving motor 50.

In more detail, the gas discharge flow channel comprises a plurality of first through holes 32 formed in the second bearing housing 30 in order to enable the gas which has been second-stage compressed in the second compressing chamber B to flow into the motor chamber M, a plurality of second through holes 53 formed in the driving motor 50 in order to enable the gas flowed into the motor chamber M through the first through hole 32 to pass the driving motor 50, and an outlet 11*a* formed in the side of the sealed container 10 in order to enable the gas cooling the driving motor 50 to be discharged to the outside of the sealed container 10.

It is advisable to form the second through hole 53 in the side of the stator 51 of the driving motor 50.

This shape of the driving shaft 60 will now be described in more detail. In the driving shaft 60, the outer diameter d1 of the driving shaft 60 near the second bearing housing 30 is the same or smaller than the outer diameter d2 of the rotor 52, and in the bearing bush 70, the outer diameter d3 of the driving shaft 60 placed inside of the first bearing housing 20 is smaller than the outer diameter d2 of the rotor 52.

Accordingly, the outer diameter of the driving shaft 60 is formed so as to be stepped, and accordingly the driving shaft 60 can be smoothly inserted into the insides of the bearing housings 20, 30.

An axial supporting means 160 for supporting the driving shaft 60 in the axial direction against force affecting the driving shaft 60 due to pressure differences between the first compressing chamber A, motor chamber M and second compressing chamber B is installed between the side surface of the bearing bush 70 and the side surface of the sealing member 80.

Figure 5:
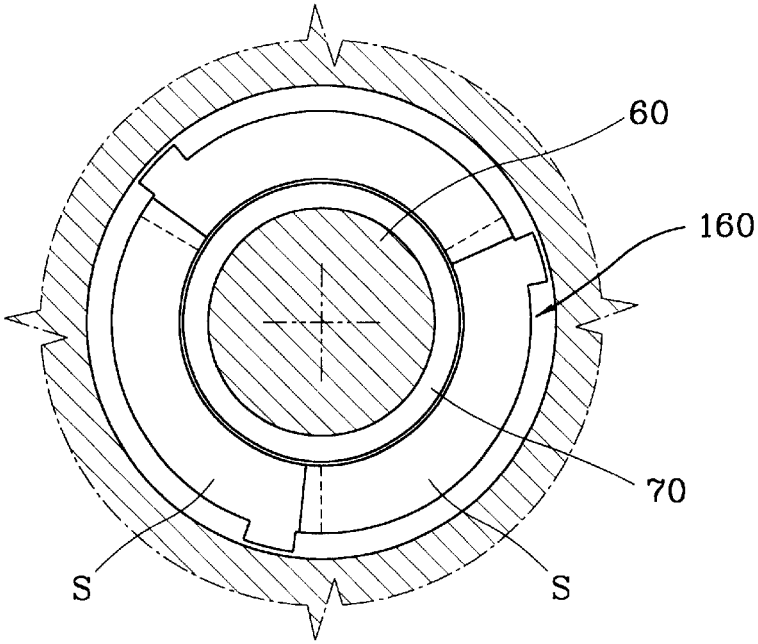
FIG. 5 is a front view illustrating an axial supporting means constructing the turbo compressor in accordance with the present invention.

As depicted in FIG. 5, the axial supporting means 160 comprises a plurality of foils S having a thin plate shape.

In more detail, the driving shaft 60 connected at the both ends thereof with the first and second impellers 100, 110 compressing the refrigerant gas while rotating respectively in the first and second compressing chambers A, B receives the force from the one axial direction or both axial directions, but it can rotate in the stably supported state without lean.

The inlet F1 placed on the first compressing chamber A is connected to an evaporator (not shown), the outlet 11*a* of the sealed container 10 is connected to a condenser (not shown), and the sealed container 10 is fixedly supported by a holder 170 having a certain shape.

Next, the operation and effect of the turbo compressor in accordance with the present invention will now be described.

First, when the power is applied, the rotor 52 is rotated in accordance with the interaction of the stator 51 and rotor 52 of the driving motor 50.

As described above, when the rotor 52 of the driving motor 50 rotates, the driving shaft 60 combined with the rotor 52 rotates, whereby the driving force of the driving shaft 60 is transmitted to the first and second impellers 100, 110, and accordingly the first and second impellers 100, 110 are respectively rotated in the first and second compressing chambers A, B.

When the first and second impellers 100, 110 are rotated, the refrigerant gas passing from the evaporator through the inlet F1 connected to the first compressing chamber A flows into the first compressing chamber A, and is one-step-pressed.

The refrigerant gas after being first-stage compressed in the first compressing chamber A flows into the second compressing chamber B through he inlet F2 formed in the second compressing chamber B through the inner connection pipe 150, and is second-stage compressed in the second compressing chamber B.

The refrigerant gas after being second-stage compressed in the second compressing chamber B flows into the motor chamber M through the first through hole 32, cools the driving motor 50 while flowing into the motor chamber M through the second through hole 53, and the refrigerant gas after cooling the driving motor 50 is discharged to the condenser through the outlet 11*a*.

In other words, the refrigerant gas after being second-stage compressed in the second compressing chamber B is discharged to the condenser through the gas discharge flow channel.

The refrigerant compressing process in the first and second compressing chambers A, B will now be described. The refrigerant gas flowing through the inlets F1, F2 has a dynamic pressure thereof increased by a centrifugal force imparted thereto while flowing between each of shroud portions 12*a*, 13*a* and the wings of the impellers 100, 110 by the rotating force of the impellers 100, 110. And, the dynamic pressure of the refrigerant gas is converted into static pressure while passing through each diffuser member 130, 140 and volute portions 12*b*, 13*b* continually, and accordingly the pressure is heightened.

In the refrigerant gas compressing process, because the pressure in the first compressing chamber A is smaller than the pressure in the second pressing chamber B and motor chamber M, the axial force affects on the driving shaft 60.

The force affecting the driving shaft 60 in the axial direction is borne by the plurality of foils acting as the axial supporting means 160 performing the gas bearing function and installed between the sealing member 80 and bearing bush 70.

The radial force affecting the driving shaft 60 and parts connected to the driving shaft 60 is borne by the plurality of foils acting as the radial supporting means 90 and performing the gas bearing function between the outer circumference of the driving shaft 60 and the inner circumference of the first and second bearing housings 20, 30.

In addition, pressure leakage due to the pressure difference between the motor chamber M and the first compressing chamber A is prevented by the labyrinth sealing part 81 of the sealing member 80.

Accordingly, in the turbo compressor in accordance with the present invention, the gas is consecutively compressed and is discharged while its dynamic pressure is converted into the static pressure by the rotating force of the first and second impellers 100, 110, and accordingly vibration noise is lowered and compressing performance is heightened.

And, among the parts constructing the compressing chamber, when the parts for fixing the position in the axial direction are fastened by the pins P1, P2, P3 without using bolts etc., and fixedly connected by the first and second cover plates 12, 13 of the sealed container 10, the productivity can be improved.

In addition, the first and second cover plates 12, 13 are produced by a press fabrication, and after the press fabrication, the shroud portion 12*a* requiring accurate measure is after-processed, and accordingly the manufacturing cost and manufacturing time can be reduced.

And, because the outer diameter of the driving shaft 60 is formed so as to be stepped, the driving shaft 60 can be smoothly inserted inside of the first and second bearing housings 20, 30.

In other words, in assembling, after the first and second bearing housings 20, 30 are connected to the sealed container 10, the driving shaft 60 can be inserted in the one direction by reducing diameter of the driving shaft 60 gradually (d3>d2>d1), and accordingly the present invention can improve the convenience of the assembly and reduce the assembly time.

In addition, the first and second bearing housings 20, 30 are connected when the fixing member 40 is pressed-inserted into the sealed container 10, and accordingly the present invention can have a simple assembly process by an easier concentric alignment of the first and second bearing housings 20, 30.

As described above, the turbo compressor in accordance with the present invention can have high compressing performance, can reduce the vibration noise, and can improve the reliability by sucking, compressing and discharging the gas consecutively while the first and second impellers convert the dynamic pressure into the static pressure by rotating in accordance with the driving force of the driving motor. In addition, the turbo compressor in accordance with the present invention can reduce the manufacturing cost and can improve the assembly productivity by simplifying the process of the construction parts and assembly process.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the metes and bounds of the claims, or equivalence of such metes and bounds are therefore intended to be embraced by the appended claims.

What is claimed is:

1. An assembly structure for a turbo compressor having a motor chamber, a first compressing chamber, and a second compressing chamber, said assembly structure comprising:

a sealed container including:

a cylinder body;

a first cover plate combined with the cylinder body at one end of the cylinder body, the first cover plate having an inlet therein;

an interconnection pipe for connecting the first compressing chamber with the second compressing chamber; and a first fixing member fixed to an inner surface of the cylinder body;

a first bearing housing having a through hole therein, and being assembled with the first fixing member by a first connecting member, thereby defining the first compressing chamber between the first cover plate and the first bearing housing;

a driving motor installed in the motor chamber; and having a driving shaft passing through the through hole in the first bearing housing;

a first impeller connected with one end of the driving shaft in the first compressing chamber;

a sealing member positioned between the first impeller and the first bearing housing, and assembled with the first bearing housing by a second connecting member, for preventing pressure leakage from the first compressing chamber; and a first diffuser member assembled with the sealing member on an outer circumference of the first impeller by a third connecting member.

2. The assembly structure of claim 1, wherein said first connecting member is a bolt.

3. The assembly structure of claim 1, wherein said second connecting member is a pin.

4. The assembly structure of claim 1, wherein said third connecting member is a pin.

5. The assembly structure of claim 1, wherein said sealing member includes a labyrinth sealing part on an inner circumference thereof.

6. The assembly structure of claim 1, further comprising a bearing bush for receiving the driving shaft therethrough, said bearing bush being inserted into the through hole in the first bearing housing.

7. The assembly structure of claim 1, further comprising a radial bearing member having a plurality of foils positioned between the bearing bush and the first bearing housing.

8. The assembly structure of claim 1, further comprising an axial bearing member having a plurality of foils positioned between the sealing member and the second bearing housing.

9. The assembly structure of claim 1, wherein said sealing member includes a labyrinth sealing part on an inner circumference thereof.

10. The assembly structure of claim 1, further comprising:

a second cover plate connected with the cylinder body at the other end of the cylinder body, the second cover plate having an inlet therein connected with the interconnecting pipe;

a second fixing member fixed to an inner surface of the cylinder body;

a second bearing housing respectively having a through hole therein passed through by the driving shaft, and being assembled with the second fixing member by a fourth connecting member, thereby defining the second compressing chamber between the second cover plate and the second bearing housing, and defining the motor chamber between the first bearing housing and the second bearing housing;

a second impeller connected with the other end of the driving shaft in the second compressing chamber; and a second diffuser member assembled with the second bearing housing on an outer circumference of the second impeller by a fifth connecting member.

11. The assembly structure of claim 10, wherein said fourth connecting member is a bolt.

12. The assembly structure of claim 10, wherein said fifth connecting member is a pin.

13. The assembly structure of claim 10, further comprising a radial bearing member having a plurality of foils positioned between the driving shaft and the second bearing housing.

14. The assembly structure of claim 10, wherein the motor chamber is connected with an outlet formed in a side of the cylinder body, said second bearing housing being formed with a plurality of first through holes therein, and a plurality of second through holes are formed in the driving motor, for enabling refrigerant gas to flow from the second compressing chamber flow into the motor chamber and be discharged from the motor chamber through the outlet.

15. The assembly structure of claim 10, wherein an outer diameter of the driving shaft decreases from the second bearing housing to the first bearing housing.

* * * * *